US008813403B2

(12) United States Patent
Weinert

(10) Patent No.: US 8,813,403 B2
(45) Date of Patent: Aug. 26, 2014

(54) APPARATUS, SYSTEM, AND METHOD FOR A CARD AND MEMORY DEVICE HOLDER

(76) Inventor: Tyson Weinert, Ewa Beach, HI (US)

( * ) Notice: Subject to any disclaimer, the term of this patent is extended or adjusted under 35 U.S.C. 154(b) by 605 days.

(21) Appl. No.: 12/917,315

(22) Filed: Nov. 1, 2010

(65) Prior Publication Data

US 2012/0103838 A1 May 3, 2012

(51) Int. Cl.
*B65D 85/57* (2006.01)
*A45C 11/18* (2006.01)

(52) U.S. Cl.
CPC ..... *A45C 11/182* (2013.01); *A45C 2200/10* (2013.01); *A45C 2011/188* (2013.01)
USPC ..... 40/649; 40/721; 206/307; 206/307.1

(58) Field of Classification Search
USPC ..... 40/649, 490, 489, 491, 576, 575, 721, 40/722
See application file for complete search history.

(56) References Cited

U.S. PATENT DOCUMENTS

| | | | | |
|---|---|---|---|---|
| 4,779,366 | A * | 10/1988 | Jost | 40/653 |
| 5,921,405 | A * | 7/1999 | Dumas | 211/40 |
| 7,048,120 | B2 * | 5/2006 | Pond | 206/366 |
| 7,556,205 | B2 * | 7/2009 | Tsang | 235/486 |
| D631,513 | S | 1/2011 | Weinert | |
| 8,376,133 | B2 * | 2/2013 | Macor | 206/0.8 |
| 2003/0056412 | A1 * | 3/2003 | Locker et al. | 40/728 |
| 2004/0108232 | A1 * | 6/2004 | Ford et al. | 206/308.1 |
| 2006/0273154 | A1 | 12/2006 | Dan | |
| 2007/0252010 | A1 | 11/2007 | Gonzalez et al. | |
| 2008/0110071 | A1 * | 5/2008 | Farnsworth et al. | 40/722 |
| 2010/0012239 | A1 | 1/2010 | Kraml | |

FOREIGN PATENT DOCUMENTS

KR 10 2008 0105245 4/2008

OTHER PUBLICATIONS

Gepe Archival Card Safe Store for 9 SD Cards, Black DVD Size Case w/Indexed Cover Sheet & Print Holder, http://www.adorama.com/GPCSS9SDB.html, originally downloaded on Sep. 9, 2010.
Lowepro PixelPak V1, http://products.lowepro.com/product/PixelPak-V1,1993.htm#, originally downloaded on Sep. 9, 2010.
PCT/US2011/058831 Written Opinion and International Search Report, Jun. 25, 2012.

* cited by examiner

*Primary Examiner* — Casandra Davis
(74) *Attorney, Agent, or Firm* — Ward and Smith, P.A.

(57) ABSTRACT

An apparatus, system, and method are disclosed for an information card holder. A base is formed in a rectangular shape with a front side and a back side. The front side has a first edge opposite a second edge. A card retainer mechanism including a first lip adjacent to the first edge of the front side of the base and a second lip is adjacent to the second edge of the front side of the base. The first and second lips may be configured to receive an edge of an information card therein (e.g. a business card). A depression is formed into the base that forms a storage compartment configured to house electronic memory storage devices (e.g. an SD card). The storage compartment is configured such that an information card retained by the first lip and second lip spans the storage compartment and retains an electronic memory storage device housed therein.

18 Claims, 12 Drawing Sheets

APPARATUS, SYSTEM, AND METHOD FOR A CARD AND MEMORY DEVICE HOLDER

BACKGROUND

1. Field

The subject matter disclosed herein relates to storing, carrying, and protecting cards and memory devices and more particularly relates to devices for protecting and carrying business cards and memory storage devices in a single, compact case.

2. Description of the Related Art

Conventionally, when a person wants to provide contact information to a potential client or customer, he provides the client with a printed business card. Such business cards provide a client with information printed on the card such as a company name, phone number, email address, or the like. The cards are typically made out of a semi-rigid material such as card-stock, cardboard, or plastic. Such cards are often kept in a person's wallet, pocket, or bag so that they are available to pass out to another person when needed. However, carrying such cards in this manner often results in damage to the cards.

Sometimes cases have been used to protect business cards from damage. However, such cases are often clumsy to handle and can make accessing the business cards more difficult. Furthermore, with the advancement of technology it may be desirable to carry more than just a business card for providing contact information. In may be desirable to carry items such as memory storage cards such as a Secure Digital ("SD") card, a cellular phone SIM card, or other memory device that can store electronic information thereon. In some instances, an advertiser may even want to pass along memory cards or chips to a potential client so that the client may view the materials later on a compatible personal electronic device. In other cases, a user may just want to carry a memory card with a business presentation or the like that can be presented to a potential client. In any event, carrying business cards and memory cards and possibly cases for each can be tedious, expensive, and difficult.

SUMMARY

From the foregoing discussion, it should be apparent that a need exists for an apparatus, system, and method that is able to provide a card holder and memory device holder. Beneficially, such an apparatus, system, and method would protect both the card and memory device, and which enables the card and memory device to be safely carried and easily accessed by a user.

The present subject matter has been developed in response to the present state of the art, and in particular, in response to the problems and needs in the art that have not yet been fully solved by currently available card holders and memory device holders. Accordingly, the present subject matter has been developed to provide an apparatus, system, and method for a card and memory device holder that overcomes many or all of the above-discussed shortcomings in the art.

The apparatus to protect and retain information cards and electronic memory storage devices is provided with a plurality of embodiments and configurations. In one embodiment, the apparatus may include a substantially planar, rigid base formed in a substantially rectangular shape. The rigid base may have a front side and a back side. The front side may have a first edge opposite a second edge. In one embodiment, the apparatus may also include a card retainer mechanism including a first lip adjacent to the first edge of the front side of the base and a second lip adjacent to the second edge of the front side of the base. The first and second lips may be configured to receive an edge of an information card therein (e.g. a business card). The first and second lips may be configured to retain the information card against the front side of the base. The apparatus may also include a depression formed into the base, wherein the depression forms a storage compartment configured to house one or more electronic memory storage devices (e.g. an SD card, SIM card, etc.). The storage compartment may be configured such that an information card retained by the first lip and second lip spans the storage compartment and retains an electronic memory storage device housed therein.

In one embodiment, the first lip is formed along the first edge of the front side of the base and the second lip is formed along the second edge of the front side of the base. The apparatus, in one embodiment, may include a transparent protector shield configured between the first edge and the second edge. The transparent protector shield may be selectively attachable to the base. In a further embodiment, the first and second lips retain the transparent protector shield. An information card may be positioned underneath the transparent protector shield. In one embodiment, the transparent protector shield has a front side and a back side. The back side may have a first edge opposite a second edge. The first lip may be formed along the first edge of the back side of the transparent protector shield and the second lip may be formed along the second edge of the back side of the transparent protector shield.

The apparatus, in one embodiment, may include a protective insert retained in the depression formed into the base, wherein the protective insert is configured with one or more voids formed into the protective insert corresponding in shape and size to one or more electronic memory storage devices. In a further embodiment, the protective insert may be made of various materials that retain an electronic memory storage device therein including a hard or soft material, an impressionable material, a foam material, and/or a foam-like material. In yet a further embodiment, the voids formed into the protective insert may be configured in the size and shape of an electronic storage device (e.g. a cell phone SIM card, an SD card, a mini SD card, a micro SD card, and a compact flash card, or similar type of memory device).

In one embodiment, the apparatus may include one or more magnetic devices attached to the back side of the base, wherein the magnetic devices facilitating attachment of the base to a metallic surface. In some embodiments, the card retainer mechanism may be formed integrally into the base. In some embodiments, a width of the base from maximum protrusion on the front side of the base to a maximum protrusion on the back side of the base is less than about 0.2 inches.

A system is also presented to protect and retain information cards and electronic memory storage devices. The system may be embodied to include the embodiments and configurations described above with regard to the apparatus. In particular, the system, in one embodiment, may include one or more electronic memory storage devices. The system may also include a substantially planar, rigid base formed in a substantially rectangular shape, the rigid base having a front side and a back side, the front side having a first edge opposite a second edge. In a further embodiment, the system may include a card retainer mechanism comprising a first lip adjacent to the first edge of the front side of the base and a second lip adjacent to the second edge of the front side of the base, the first and second lips each configured to receive an edge of an information card therein, the first and second lips configured to retain the information card against the front side of the base. In yet a further embodiment, the system may include a depression formed into the base, the depression forming a storage compartment that houses the one or more electronic memory storage devices, the storage compartment configured so that an information card retained by the first and second lips spans the storage compartment and retains the electronic memory storage device housed therein.

A method is also presented for making a mechanism for protecting and retaining information cards. The method in the disclosed embodiments substantially includes the steps necessary to carry out the functions presented above with respect to the operation and making of the described apparatus and system. In one embodiment, the method may include forming a substantially planar, rigid base in a substantially rectangular shape, the rigid base having a front side and a back side, the front side having a first edge opposite a second edge. The method also may include forming a card retainer mechanism comprising a first lip adjacent to the first edge of the front side of the base and a second lip adjacent to the second edge of the front side of the base, the first and second lips each configured to receive an edge of an information card therein, the first and second lips configured to retain the information card against the front side of the base. In further embodiment, the method may include forming a depression into the base, the depression forming a storage compartment configured to house one or more electronic memory storage devices. The storage compartment may be configured so that an information card retained by the first and second lips spans the storage compartment and retains an electronic memory storage device housed therein.

In a further embodiment, the method may include attaching a transparent protector shield configured between the first edge and the second edge, wherein the transparent protector shield is selectively attachable to the base. In one embodiment, the transparent protector shield has a front side and a back side, the back side having a first edge opposite a second edge. Furthermore, forming the card retainer mechanism may further include forming the first lip along the first edge of the back side of the transparent protector shield and forming the second lip along the second edge of the back side of the transparent protector shield. In one embodiment, the method may include forming a protective insert retained in the depression formed into the base, wherein the protective insert is configured with one or more voids formed into the protective insert corresponding in shape and size to one or more electronic memory storage devices. In a further embodiment, the protective insert may be made of various materials that retain an electronic memory storage device therein including a hard or soft material, an impressionable material, a foam material, and/or a foam-like material. In yet a further embodiment, the voids may be formed into the protective insert and are configured in the size and shape of an electronic storage device (e.g. a cell phone SIM card, a secure digital ("SD") card, a mini SD card, a micro SD card, and a compact flash card).

Reference throughout this specification to features, advantages, or similar language does not imply that all of the features and advantages that may be realized with the present subject matter should be or are in any single embodiment. Rather, language referring to the features and advantages is understood to mean that a specific feature, advantage, or characteristic described in connection with an embodiment is included in at least one embodiment of the present subject matter. Thus, discussion of the features and advantages, and similar language, throughout this specification may, but do not necessarily, refer to the same embodiment.

Furthermore, the described features, advantages, and characteristics of the subject matter may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments.

BRIEF DESCRIPTION OF THE DRAWINGS

In order that the advantages of the subject matter will be readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present subject matter. Thus, appearances of the phrases "in one embodiment," "in an embodiment," and similar language throughout this specification may, but do not necessarily, all refer to the same embodiment.

Furthermore, the described features, structures, or characteristics of the subject matter may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the subject matter. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the subject matter.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1A:
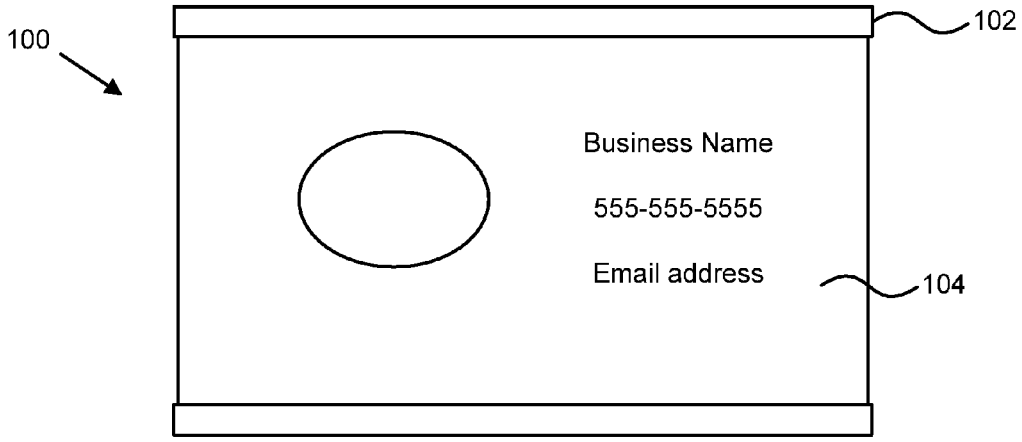
FIG. 1*a* is a top view illustrating one embodiment of an information card holder.
Figure 1B:
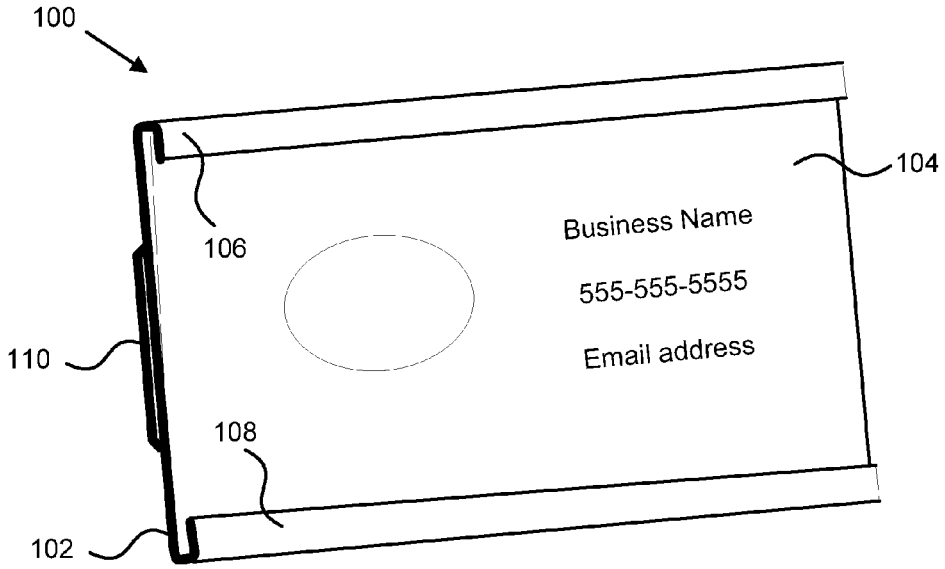
FIG. 1*b* is a perspective view further illustrating the information card holder of FIG. 1*a;*

FIG. 1*a* is a top view illustrating one embodiment of an information card holder apparatus 100. FIG. 1*b* is a perspective view further illustrating the information card holder 100 of FIG. 1*a*. The information card holder 100 includes a base 102 with an information card 104 attached. The base 102 includes a storage compartment depression 110 and a card retainer mechanism 106, 108.

In one embodiment, the base 102 is substantially planar and rigid and is formed in a substantially rectangular shape. The rigid base 102 has a front side and a back side. The front side may be oriented with a first edge opposite a second edge. In other embodiments, the base 102 may be formed in other shapes such as circles, triangles, etc. However, in at least one embodiment, the information card holder apparatus 100 is configured in a size and shape to be stored in a wallet and to hold an information card 104 of the size and shape of a common business card. For example, the apparatus 100 may be configured with a horizontal length of about 3.5 inches, a vertical height of about 2 inches, and a thickness or width of about 0.2 inches. Of course, other sizes and widths are contemplated herein.

The term substantially planar as used herein means that the base 102 is formed along a plane where the width or thickness of the plane is less than about half of the length or height of the base, whichever is lower. The front side and back side of the base 102 need not be perfectly smooth or exactly planar. For example, the depression 110, or the lips 106, 108 may protrude from the base 102. Other protrusions such as magnets, key chains, or the like are also contemplated herein. As used herein, rigid means somewhat inflexible and stiff. However, rigid does not mean completely inflexible or immovable or unbendable. For example, a rigid base 102 may be formed of rigid materials such as plastics, metals, wood, stiff rubbers, or the like. In at least one embodiment, the base is formed from aluminum.

In one embodiment, the base 102 is formed with a contiguous piece of material such as plastic from a plastic mold. In other embodiments, the base 102 may be formed of a combination of pieces that may be attached together to form the base such as by glue or welding. In one embodiment, the base 102 may be formed by cutting and bending a sheet of metal into an acceptable size and shape to receive an information card 104. In various embodiments, the base 102 is formed to be horizontally and/or vertically symmetrical.

The information card 104, in one embodiment, is a business card made of a paper product such as cardboard or card stock. In other embodiments, the information card 104 may include other types of cards such as credit cards, driver's licenses or the like, and may be constructed of other materials such as plastic, laminate, or metal. The base 104 may be formed to correspond to a desired shape and size of a known business card such that the base 104 can retain the business card 104 across the face of the base as depicted in FIGS. 1*a* and 1*b*. The business card may display information such as a business name, phone number, and email address for use by a potential client or customer. In one embodiment, the base 102 may be configured to retain a plurality of business cards so that one card may be removed and passed to a client, wherein the remaining business cards are retained against the face of the base 102.

In one embodiment, the card retainer mechanism includes a first lip 106 adjacent to and/or formed along the first edge of the front side of the base 102 and a second lip 108 adjacent to and/or formed along the second edge of the front side of the base 102. In the depicted embodiment, the first and second lips 106, 108 are each configured to receive an edge of an information card 104 therein. The first and second lips 106, 108 may be configured to retain the information card against the front side of the base 102 as depicted. In this embodiment, the lips 106, 108 of the card retainer mechanism are configured as folded edges extending from a first and second edge of the base 102. The lips 106, 108 are configured so that an information card 104 may be slid into position from a side edge of the base 102 and retained by the lips 106, 108. In other embodiments, the card retainer mechanism may include other mechanisms such as magnets, clamps, clips, or the like that can retain an information card 104 in position relative to the base 102.

In the depicted embodiment, the lips 106, 108 span the length of the base 102 along a first edge and second edge. However, in other embodiments, lips may be formed to span the side edge of the base 102 and may be formed to span only a portion of the edges of the base 102. For example, in one embodiment lips may be formed at the corners of the base 102. In another embodiment a lip may be formed around the entire circumference of the base 102.

In various embodiments, the lips 106, 108 are formed integrally with the base 102 such that they are formed into a single piece of material. In other embodiments, the lips 106, 108 may be configured to attach to the base 102 by other means such as glue or welding. In one embodiment, the lips 106, 108 are formed by bending an edge of the base 102 inward to form the lips 106, 108. The thickness of the area beneath the lips 106, 108, (i.e. between the lips 106, 108 and the front side of base) may be configured to correspond to a thickness of an information card 104 or a plurality of information cards 104. In one embodiment, the thickness of the area beneath the lips 106, 108 is about 0.01-0.04 inches.

In the depicted embodiment, a depression is formed into the base 102. As depicted, the depression 110 forms a storage compartment 110 configured to house one or more electronic memory storage devices. The storage compartment 110 is configured such that an information card retained by the first lip and second lip spans the storage compartment 110 formed by the depression and retains an electronic memory storage device housed therein. In one embodiment, the storage compartment 110 may be formed integrally with the base 102, such as by bending or shaping a material to form the storage compartment. In alternate embodiments, the storage compartment may be formed separate from the base 102 and attached thereto.

Figure 2:
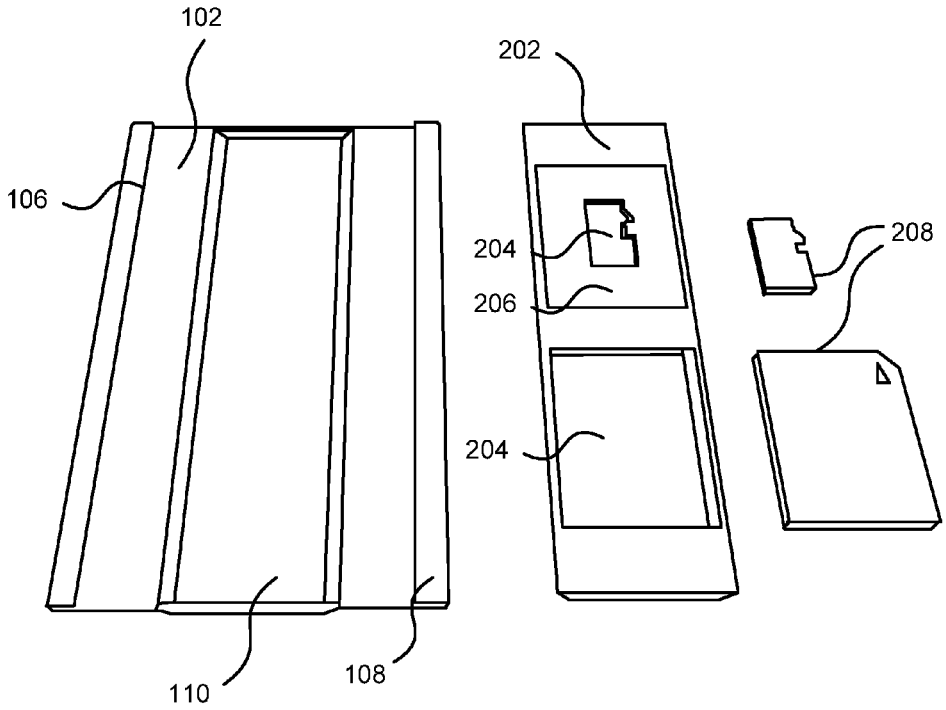
FIG. 2 is a perspective view illustrating the information card holder of FIG. 1 with a protective insert.

As depicted, the storage compartment 110 includes a depression formed along a middle portion of the base 102. However, the depression and storage compartment 110 may be formed along any suitable portion of the base 102 and is not limited to the middle portion of the base 102. For example, the depression may be formed along an upper portion of the base, a lower portion of the base, and the like. In addition, in other embodiments, the storage compartment 110 may be formed to span the entire base. For example, a storage compartment 110 may be formed beneath the information card 104 with height and length dimensions substantially similar to that of the information card 104. In some embodiments, the storage compartment 110 is formed with a width or depth corresponding to a thickness of an electronic memory storage card such as an SD card. FIG. 2 depicts additional details of one embodiment of the apparatus 100 and storage compartment 110.

FIG. 2 is a perspective view illustrating the information card holder of FIG. 1 with a protective insert. In the depicted embodiment, the base 102 is shown with the information card 104 removed from the lips 106, 108. The storage compartment 110 can be seen as void spanning from one side to another side of the base 102.

In one embodiment, a protective insert 202 may be inserted into the storage compartment 110 to provide further protection and retention of one or more electronic memory storage devices 208. The protective insert 202 may be retained in the depression formed into the base 102. In one embodiment, the protective insert is configured with one or more voids 204 formed into the protective insert 202 that correspond in shape and size to the electronic memory storage devices 208. An electronic memory storage device 208 may include, but is not limited to, a cellular phone SIM card, a secure digital ("SD") card, a mini SD card, a micro SD card, a compact flash card, and/or any other suitable storage device. Furthermore, the electronic memory storage device 208 may be read, written to, and/or otherwise accessed by a computing or other electronic device such as a computer, a cellular phone, a handheld computing device, a portable computer, a server, a camera, a Personal Desktop Assistant ("PDA"), and the like.

In various embodiments, the protective insert 202 is made of a material that retains an electronic memory storage device 208 therein. The material may be a hard or a soft and/or impressionable material and may include, but is not limited to, a foam material or a foam-like material. The material may be configured with voids that closely fit the size and shape of conventional electronic memory storage devices 208. The material may be configured to provide a force against an edge of the electronic memory storage devices 208 to retain and protect the electronic memory storage devices 208 within the storage compartment 110. In some embodiments, a secondary protective insert 206 may be provided that when inserted into one of the voids 204 forms a new void of a different shape and size, perhaps one that corresponds to a different shape and size electronic memory storage device 208.

In one embodiment, the voids formed into the protective insert 202 are configured in the size and shape of one or more of a cellular phone SIM card, a secure digital ("SD") card, a mini SD card, a micro SD card, and a compact flash card. In further embodiments, other types of devices such as IPODS, key drives, or the like may also be used.

When assembled, the protective insert may be placed into the storage compartment 110, and the electronic memory storage devices 208 may be placed into the voids 204 of the protective inserts 202, 206. The information card 104 may then be retained in position under the lips 106, 108 to further protect and retain the electronic memory storage devices 208. In this manner, the apparatus 100 is able to protect, retain, and provide a carrying mechanism that incorporates both printed information cards 104 and electronic memory storage devices 208.

Figure 3:
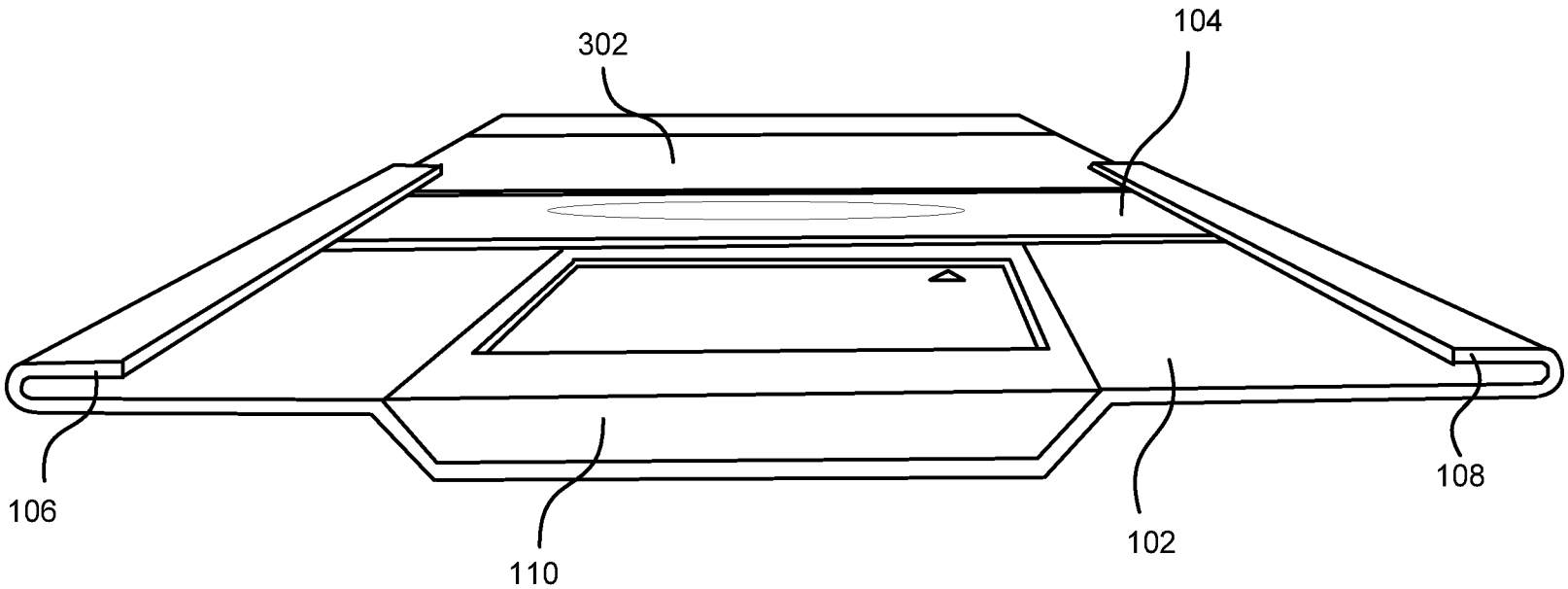
FIG. 3 is a perspective view further illustrating the information card holder of FIG. 1 with an information card and transparent protector shield partially inserted.

FIG. 3 is a perspective view further illustrating the information card holder apparatus 100 of FIG. 1 with an information card 104 and transparent protector shield 302 partially inserted. In the depicted embodiment, a transparent protector shield 302 may be provided to further protect the information card 104 from scratches or dislodgement or the like. In one embodiment, the transparent protector shield 302 is configured to slide over top of the information card 104 and be retained by the lips 106, 108 in position above the storage compartment 110. The transparent protector shield 302 may be constructed from a material such as laminate, plastic, plexi-glass, glass, or the like. In one embodiment, the transparent protector shield 302 is configured between the first edge 106 and the second edge 108, and the transparent protector shield is selectively attachable to the base.

In operation, the transparent protector shield 302 may be used to provide additional protection to the storage compartment 110 such as when an information card is given out to a client or customer. The transparent protector shield 302 may also be configured to provide an additional retaining force against the information card 104 to further retain the information card 104 in position against the base 102.

Figure 4:
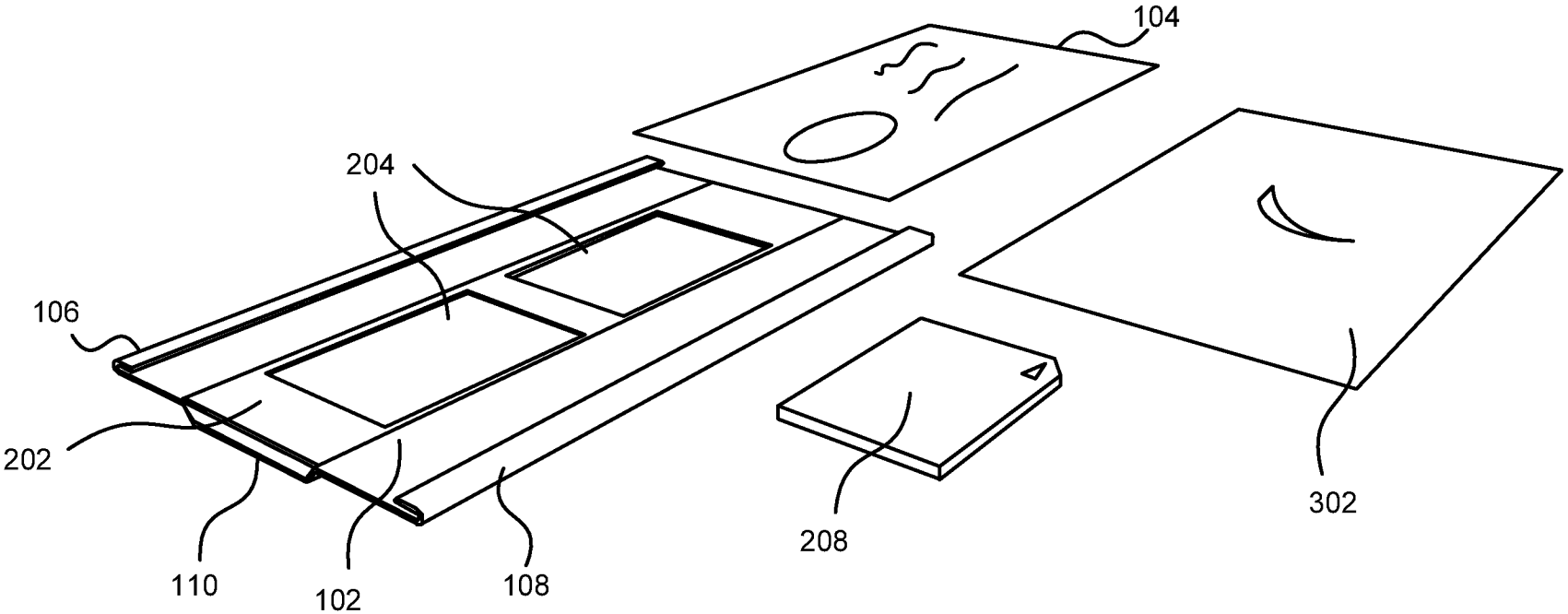
FIG. 4 is a perspective view further illustrating the information card holder of FIG. 1 with an information card(s) and transparent protector shield and the potential to store multiple electronic storage devices.

FIG. 4 is a perspective view further illustrating the information card holder apparatus of FIG. 1 with an information card 104 and transparent protector shield 302. The depicted embodiment shows the apparatus with the information card 104 and transparent protector shield 302 removed from the device. In operation, the electronic memory storage device 208 is placed into one of the voids 204 and the information card 104 and transparent protector shield 302 are placed over the electronic memory storage device 208 to protect and retain the electronic memory storage device 208. In order to access the storage compartment 110, the information card 104 and/or transparent protector shield 302 are removed from the base 102. This may be done by sliding the information card 104 and/or transparent shield 302 out the side of the base 102 as guided by the lips 106, 108.

Figure 5:
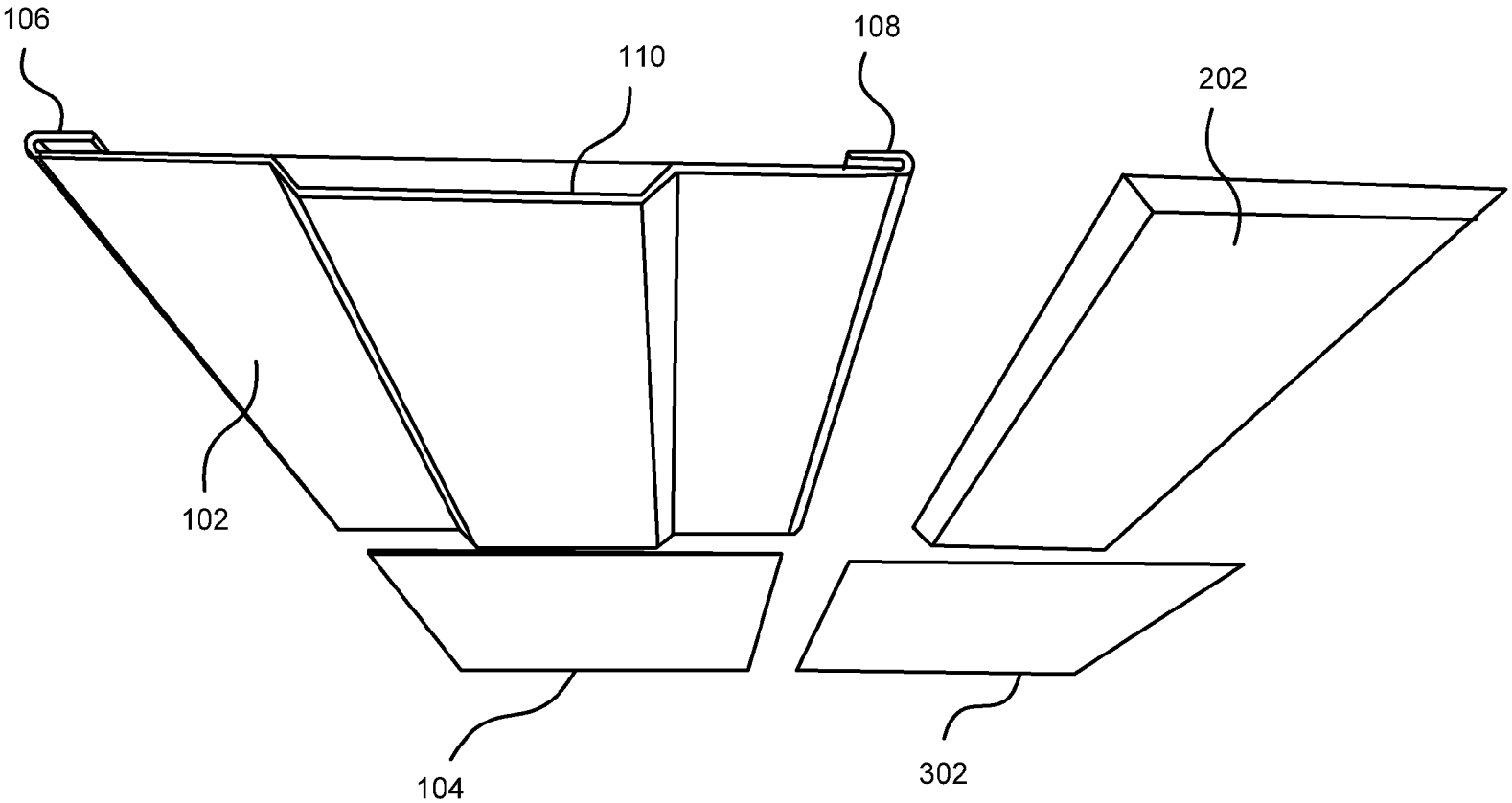
FIG. 5 is a bottom perspective view further illustrating the information card holder of FIG. 1.

FIG. 5 is a bottom perspective view further illustrating the information card holder apparatus 100 of FIG. 1. As shown in the depicted embodiment, the storage compartment 110 protrudes slightly from the rest of the back side of the base 102. In other embodiments, the storage compartment 110 or base 102 may be configured so that a smooth surface is created along the back side of the base. For example, the storage compartment 110 may be expanded to match the dimensions of the base 102 or a filler material or thicker base material may be used to create a uniform surface along the back side of the base 102. In one embodiment, magnets may be used to fill in the space on the back side of the base 102, and the magnets may be used to facilitate attachment of the device to a metallic surface such as a refrigerator.

The underside of the protective insert 202, the information card 104, and the transparent protective shield 302 are also depicted. In further embodiments, of course, different shapes, sizes, textures, and configurations of these elements are contemplated.

Figure 6:
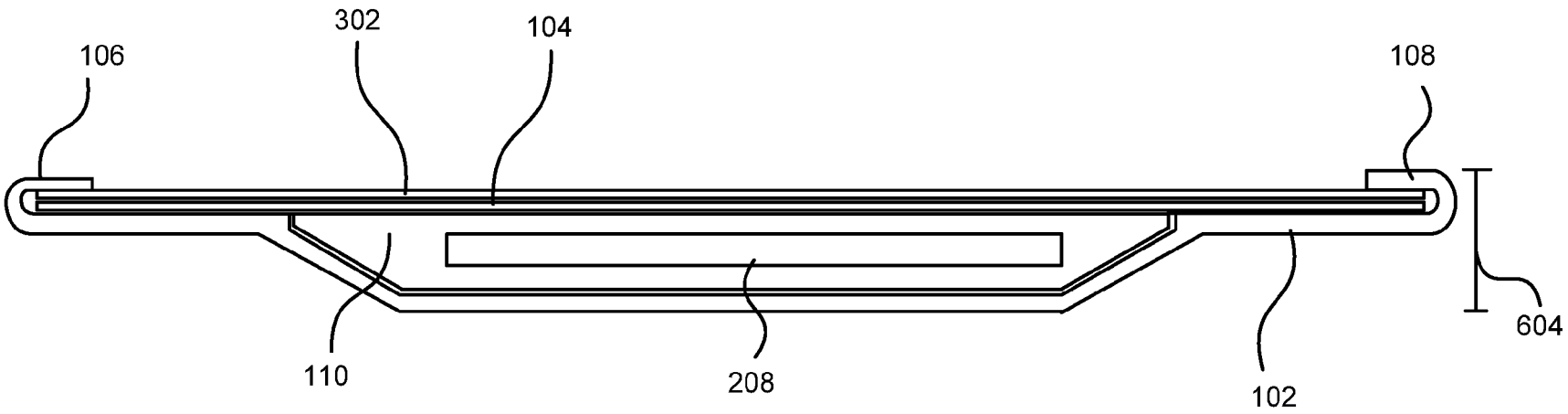
FIG. 6 is a cross-section view further illustrating the information card holder of FIG. 1.

FIG. 6 is a cross-section view further illustrating the information card holder apparatus 100 of FIG. 1. The cross-section view depicts the base 102, the information card 104, the first lip 106 and second lip 108, the storage compartment 110, and the transparent protective shield 302. A thickness or width 604 is defined as a distance from a maximum protrusion on the front side of the base (i.e. the lips 160, 108) to a maximum protrusion on the back side of the base (i.e. the bottom part of the storage compartment 110). In one embodiment, the width 604 is less than about 0.2 inches. In various embodiments, the width may be selected to accommodate storage of the apparatus 100 in a location such as a wallet sleeve or purse sleeve, and may also be configured to minimize the width 604 while retaining and storing one or more information cards 104 and one or more electronic memory storage devices.

Figure 7A:
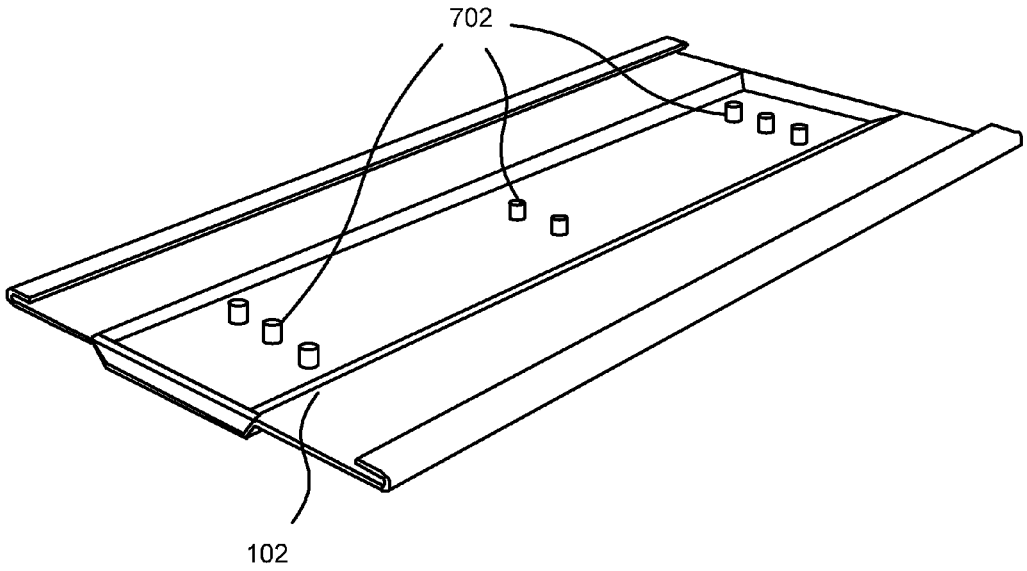
FIG. 7*a* is a perspective view illustrating an embodiment of a base configured to receive a protective insert.
Figure 7B:
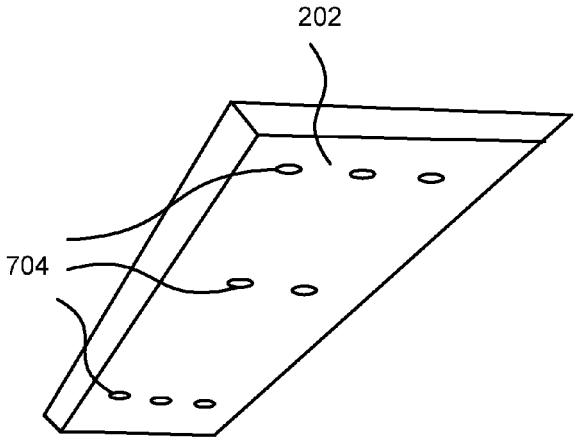
FIG. 7*b* is a perspective view illustrating one embodiment of a protective insert.

FIG. 7*a* is a perspective view illustrating an embodiment of a base 102 configured to receive a protective insert 202. FIG. 7*b* is a perspective view illustrating one embodiment of a protective insert 202 configured to attach to a base 102. In the depicted embodiment, the base 102 is formed with a plurality of protrusions 702 configured to engage a plurality of receptor holes 704 formed into the protective insert 202. In further embodiments, other shapes, sizes, and configurations of the protrusions 702 and receptor holes are also contemplating. The protrusions 702 may be sized with respect to the receptor holes 704 such that friction sufficiently retains the protective insert 202 in position in the storage compartment 110 of the base 102. In additional embodiments, other mechanisms may be used alternatively or in addition to the protrusions 702 and receptor holes 704 including adhesives such as glue or the like.

Figure 8:
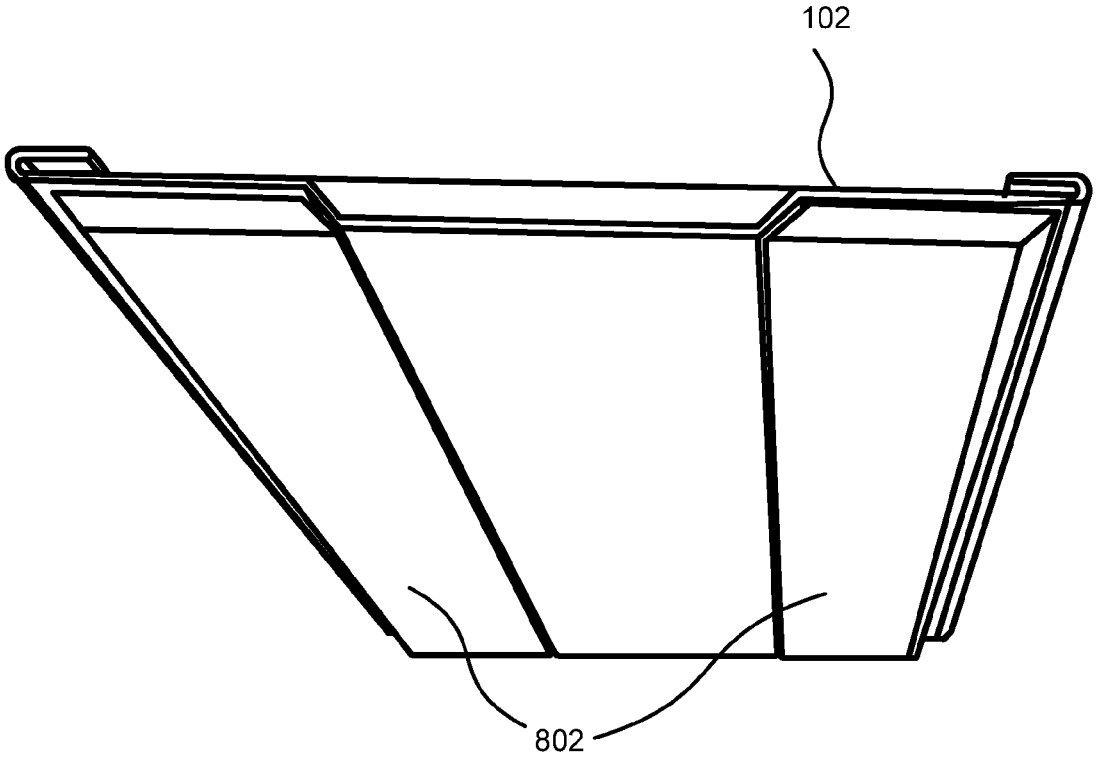
FIG. 8 is a bottom perspective view illustrating one embodiment of the information card holder of FIG. 1 with magnetic devices attached.

FIG. 8 is a bottom perspective view illustrating one embodiment of the information card holder apparatus 100 of FIG. 1 with magnetic devices 802 attached. As noted, the magnetic devices 802 may be used to facilitate attachment of the apparatus 100 to a metallic or magnetic surface. Additionally, the magnetic devices 802 may be used to fill empty space on the back side of the base 102 to give a more uniform surface thereto. In some embodiments, the magnetic devices 802 may be selectively detachable from the base 102. In other embodiments, the magnetic device 802 may be permanently attached to the base 102. In various embodiments, different shapes, sizes, and configurations of the magnetic devices 802 are also contemplated. In at least one embodiment, the base 102 may be constructed of a material to which the magnetic devices 802 may be attached to such as a ferrous metal.

Figure 9:
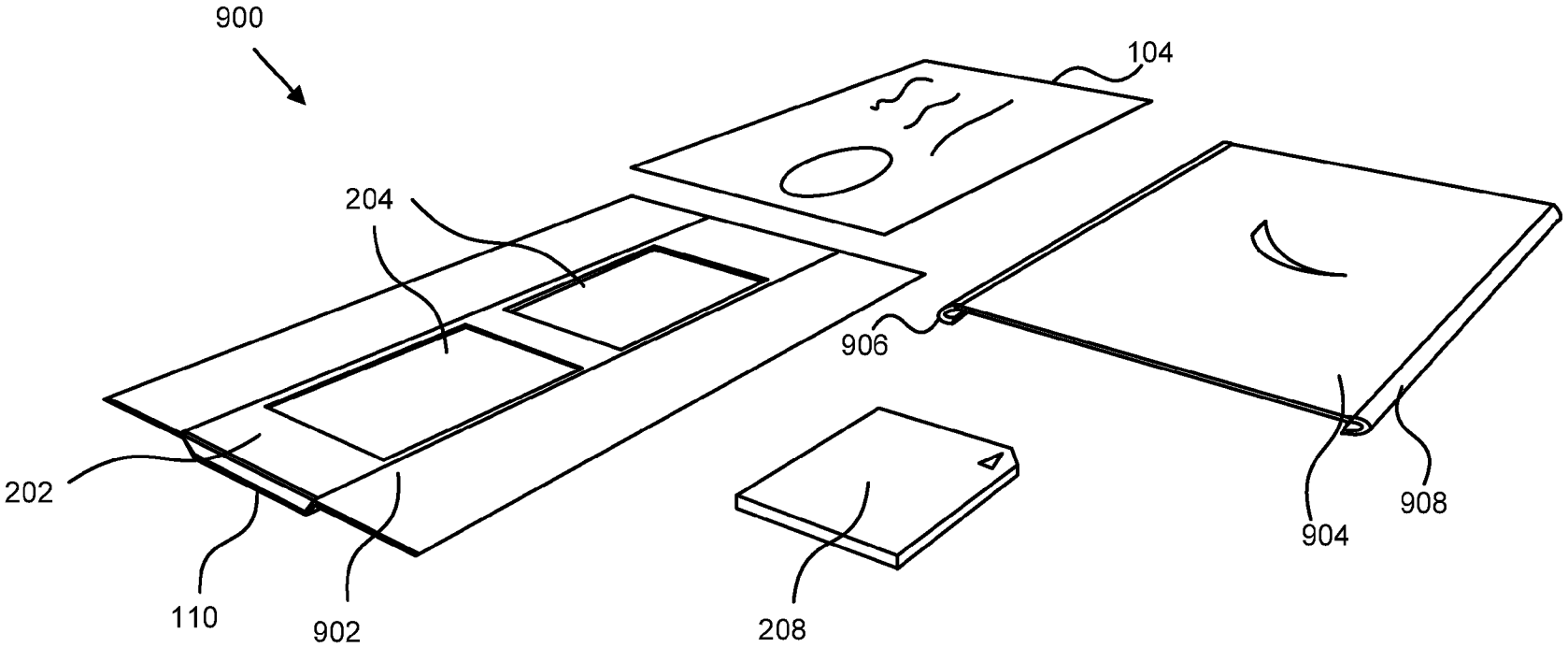
FIG. 9 is a perspective view illustrating another embodiment of an information card holder with an information card and transparent protector shield.

FIG. 9 is a perspective view illustrating another embodiment of an information card holder apparatus 900 with a transparent protector shield 904. The depicted embodiment shows the apparatus 900 with an information card 104 and transparent protector shield 904 removed from the device. The information card 104, storage compartment depression 110, the protective insert 202, the voids 204, and the memory storage device 208 may be substantially similar to the like-numbered elements in FIGS. 1 through 8. The base 902 may be similar to the base 102 described above in relation to FIGS. 1 through 8. However, the base 902 lacks the card retainer mechanism 106, 108 depicted in FIGS. 1 though 8 and described above. Instead, the depicted apparatus 900 includes a card retainer mechanism 906, 908 coupled to the transparent protector shield 904.

In this embodiment, the transparent protector shield 904 has a front side and a back side. In addition, the back side has a first edge opposite a second edge. The card retainer mechanism 906, 908 includes a first lip 906 formed along the first edge of the back side of the transparent protector shield 904 and a second lip 908 formed along the second edge of the back side of the transparent protector shield 904. The first lip 906 is configured to receive the information card 104 and the first edge of the front side of the base 902 and the second lip 908 is configured to receive the information card 104 and the second edge of the front side of the base 902.

Similar to the information card holder apparatus 100 described above, in operation, the electronic memory storage device 208 is placed into one of the voids 204 and the information card 104 is placed over the electronic memory storage device 208. Then, the transparent protector shield 904 may be placed over the information card 104 and electronic memory storage device 208, engaged with the base 902 by way of the first lip 906 and the second lip 908, to protect and retain the electronic memory storage device 208. In order to access the storage compartment 110, the information card 104 and/or transparent protector shield 904 are removed from the base 902. This may be done by sliding the base 902 out the side of the transparent protector shield 904 as guided by the lips 906, 908.

Similar to the card retainer mechanism 106, 108 as described above in relation to FIGS. 1 through 8, the first and second lips 906, 908 may be configured to retain the information card 104 against the front side of the base 902. In this embodiment, the lips 906, 908 of the card retainer mechanism are configured as folded edges extending from the first edge and the second edge of the transparent protector shield 904. The lips 906, 908 are configured so that an information card 104 and/or base 902 may be slid into position from a side edge of the transparent protector shield 904 and retained by the lips 906, 908. In other embodiments, the card retainer mechanism 906, 908 may include other mechanisms such as magnets, clamps, clips, or the like that can retain an information card 104 in position relative to the base 902 by way of the transparent protector shield 904.

The depicted lips 906, 908 span the length of the base 902 along the first edge and the second edge. However, in other embodiments, lips may be formed to span the side edge of the transparent protector shield 904 and may be formed to span only a portion of the first edge and the second edge of the transparent protector shield 904. For example, in one embodiment lips may be formed at the corners of the transparent protector shield 904. In another embodiment a lip may be formed around the entire circumference of the transparent protector shield 904.

In various embodiments, the lips 906, 908 are formed integrally with the transparent protector shield 904 such that they are formed into a single piece of material. In other embodiments, the lips 906, 908 may be configured to attach to the transparent protector shield 904 by other means such as glue or welding. In one embodiment, the lips 906, 908 are formed by bending an edge of the transparent protector shield 904 inward to form the lips 906, 908. The thickness of the area beneath the lips 906, 908, (i.e. between the lips 906, 908 and the back side of the transparent protector shield 904) may be configured to correspond to a thickness of an information card 104 or a plurality of information cards 104 and edges of the base 902.

Figure 10:
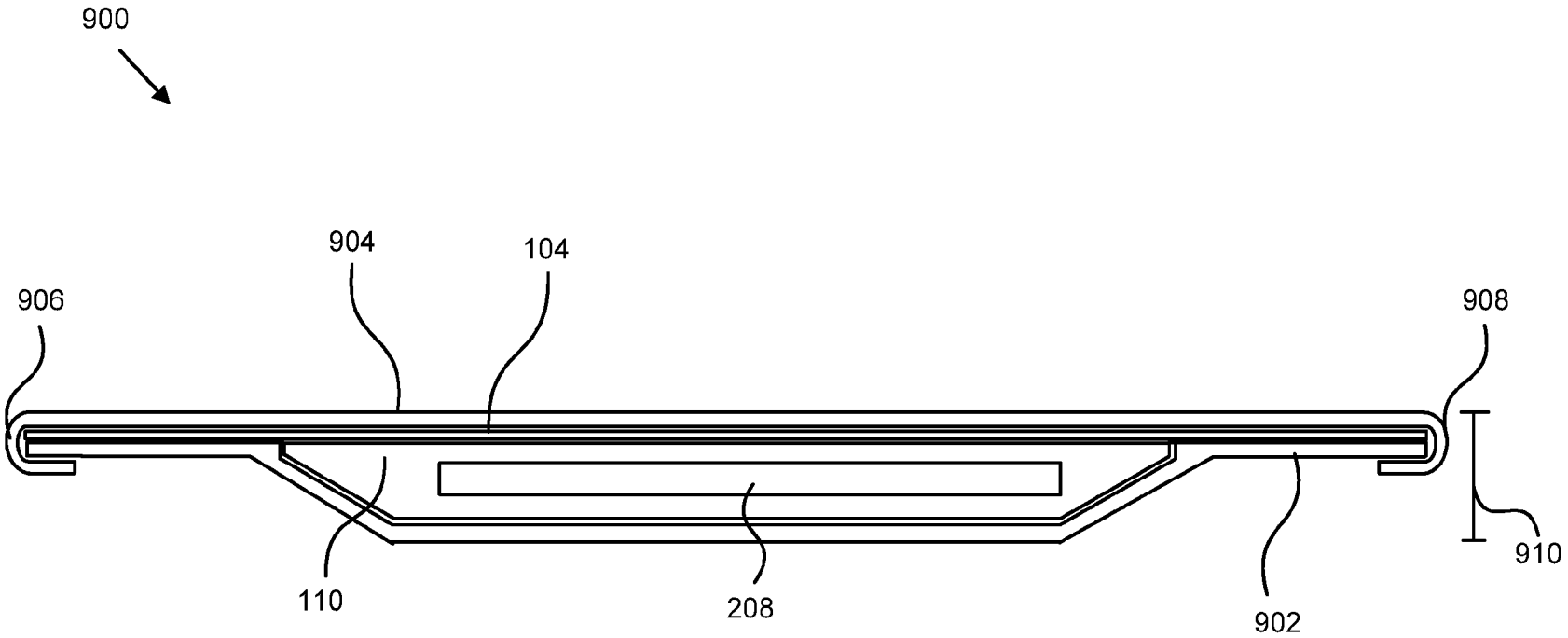
FIG. 10 is a cross-section view illustrating the information card holder of FIG. 9.

FIG. 10 is a cross-section view further illustrating the information card holder apparatus 900 of FIG. 9. The cross-section view depicts the base 902, the information card 104, the first lip 906 and second lip 908, the storage compartment 110, and the transparent protective shield 904. As depicted, the first lip 906 is adjacent to and/or engaged with the first edge of the front side of the base 902 and the second lip 908 is adjacent to and/or engaged with the second edge of the front side of the base 902. The width 910 may be similar to that described above in relation to the apparatus 100 of FIGS. 1 through 8.

Figure 11:
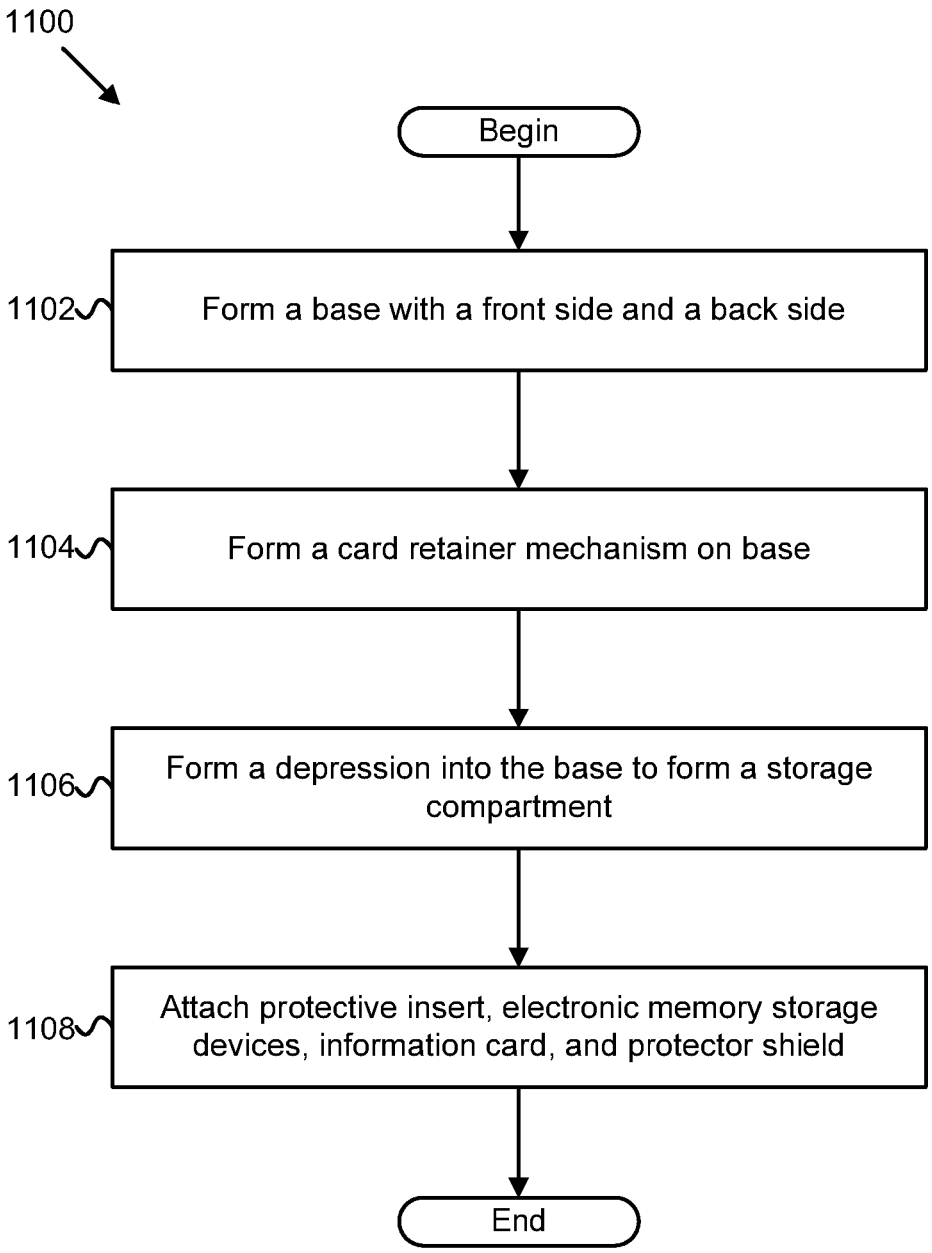
FIG. 11 is a schematic block diagram illustrating one embodiment of a method for making an information card holder.

FIG. 11 is a schematic block diagram illustrating one embodiment of a method 1100 for making an information card holder apparatus. The method 1100 may include or may be altered to include steps corresponding to making the apparatus including the various embodiments and configurations described above with regard to FIGS. 1 through 8.

First, a substantially planar, rigid base 102 is formed 1102 in a substantially rectangular shape, the rigid base 102 having a front side and a back side, the front side having a first edge opposite a second edge. Next, a card retainer mechanism is formed 1104, the card retainer mechanism comprising a first lip 106 adjacent to and/or formed along the first edge of the front side of the base and a second lip 108 adjacent to and/or formed along the second edge of the front side of the base. The first and second lips 106, 108 may each be configured to receive an edge of an information card 104 therein, and the first and second lips 106, 108 may be configured to retain the information card 104 against the front side of the base 102.

Next, a depression formed 1106 into the base 102, the depression forming a storage compartment 110 that is configured to house the one or more electronic memory storage devices 208. The storage compartment may be further configured so that an information card 104 retained by the first and second lips 106, 108 spans the storage compartment 110 and retains the electronic memory storage device 208 housed therein.

Finally, a protective insert 202, electronic memory storage device 208, information card 104, and/or transparent shield may be attached 1108 to the base 102.

Figure 12:
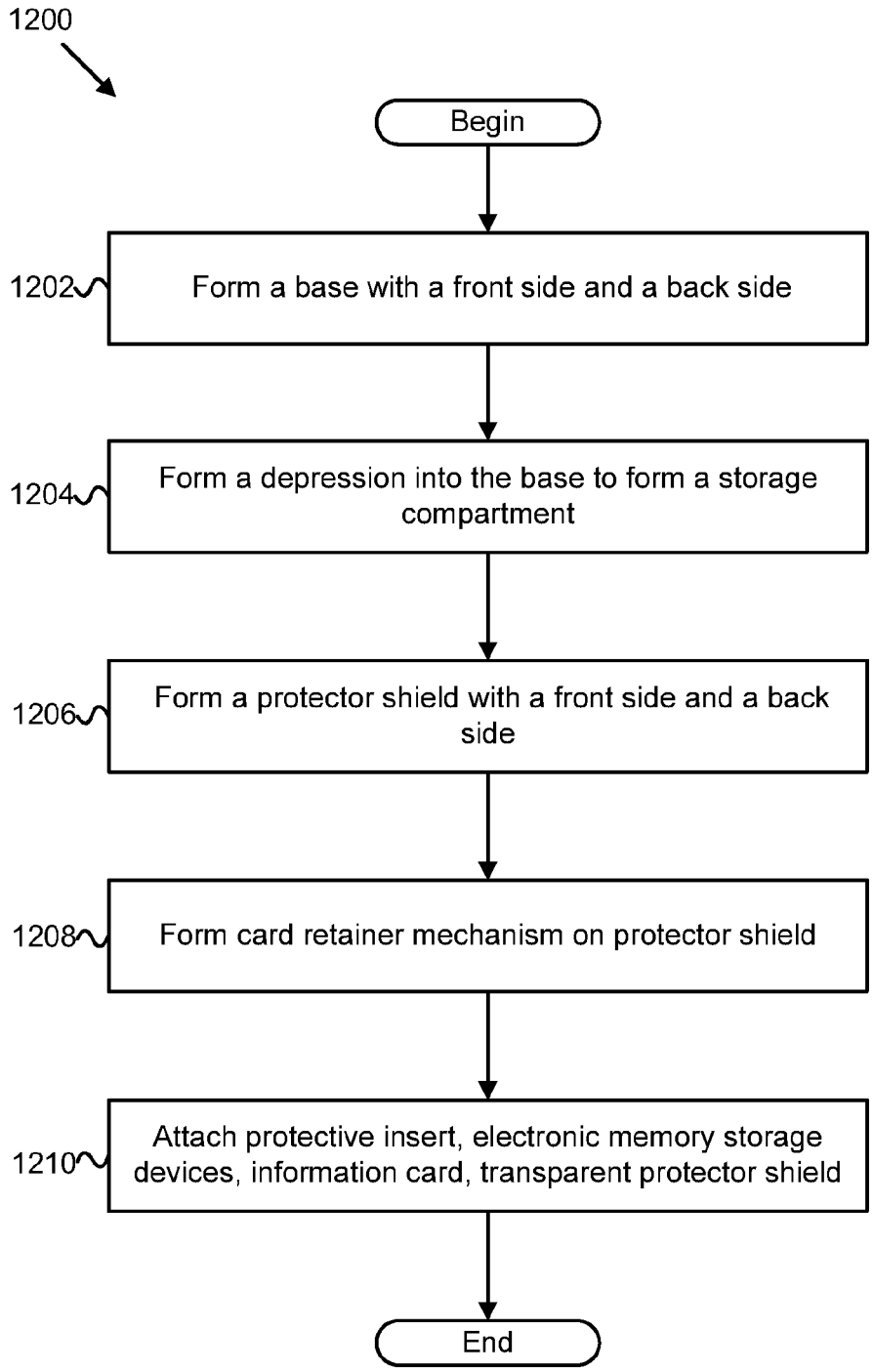
FIG. 12 is a schematic block diagram illustrating another embodiment of a method for making an information card holder.

FIG. 12 is a schematic block diagram illustrating another embodiment of a method 1200 for making an information card holder apparatus. The method 1200 may include or may be altered to include steps corresponding to making the apparatus including the various embodiments and configurations described above with regard to FIGS. 1 through 10 and particularly embodiments depicted in FIGS. 9 and 10.

First, a substantially planar, rigid base 902 is formed 1202 in a substantially rectangular shape, the rigid base 902 having a front side and a back side, the front side having a first edge opposite a second edge. Next, a depression formed 1204 into the base 902, the depression forming a storage compartment 110 that is configured to house the one or more electronic memory storage devices 208. The storage compartment 110 may be further configured so that an information card 104 spans the storage compartment 110 and retains the electronic memory storage device 208 housed therein.

Next, a transparent protector shield 904 is formed 1206 having a front side and a back side, the back side having a first edge opposite a second edge. Then, the card retainer mechanism 906, 908 is formed 1208 on the transparent protective shield, the card retainer mechanism 906, 908 comprising a first lip 906 formed along the first edge of the back side of the protective shield and a second lip 908 formed along the second edge of the back side of the protective shield. The first and second lips 906, 908 may each be configured to receive an edge of an information card 104 and an edge of the base 902 therein, being adjacent to the edges of the base 902, and the first and second lips 906, 908 may be configured to retain the information card 104 against the front side of the base 902.

Finally, a protective insert 202, electronic memory storage device 208, information card 104, may be attached 1210 to the base 902 using the transparent protector shield 904.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for protecting and retaining information cards and one or more electronic memory storage devices, the apparatus comprising:

a substantially planar, rigid base formed in a substantially rectangular shape, the rigid base having a front side and a back side, the front side having a first edge opposite a second edge;

a protector shield comprising a first lip and a second lip, the first and second lips each configured to receive the first edge and second edge of the base, and wherein the protector shield is selectively attachable to the base; and a depression formed into the base, the depression forming a storage compartment housing one or more electronic memory storage devices, the storage compartment configured such that the protector shield, when attached to the base, substantially fully encloses the storage compartment and retains an information card and the one or more electronic memory storage device housed therein.

2. The apparatus of claim 1, wherein the protector shield is transparent.

3. The apparatus of claim 2, wherein the transparent protector shield has a front side and a back side, the back side having a first edge opposite a second edge, and wherein the first lip is formed along the first edge of the back side of the transparent protector shield and the second lip is formed along the second edge of the back side of the transparent protector shield.

4. The apparatus of claim 1, further comprising a protective insert retained in the depression formed into the base, wherein the protective insert is configured with one or more voids formed into the protective insert corresponding in shape and size to one or more electronic memory storage devices.

5. The apparatus of claim 4, wherein the protective insert is made of a material that retains an electronic memory storage device therein, wherein the material comprises one or more of a hard material, a soft material, an impressionable material, a foam material, and a foam-like material.

6. The apparatus of claim 4, wherein the voids formed into the protective insert are configured in the size and shape of one or more of a cellular phone SIM card, a secure digital ("SD") card, a mini SD card, a micro SD card, a USB to flash memory adapter, and a compact flash card.

7. The apparatus of claim 1, further comprising one or more magnetic devices attached to the back side of the base, the magnetic devices facilitating attachment of the base to a metallic surface.

8. The apparatus of claim 1, wherein a width of the base from maximum protrusion on the front side of the base to a maximum protrusion on the back side of the base is less than about 0.2 inches (6 mm).

9. A system for protecting and retaining information cards and one or more electronic memory storage devices, the system comprising:

one or more electronic memory storage devices;

a substantially planar, rigid base formed in a substantially rectangular shape, the rigid base having a front side and a back side, the front side having a first edge opposite a second edge;

a protector shield comprising a first lip and a second lip, the first and second lips each configured to receive the first edge and second edge of the base, and wherein the protector shield is selectively attachable to the base; and a depression formed into the base, the depression forming a storage compartment that houses the one or more electronic memory storage devices, the storage compartment configured so that the protector shield, when attached to the base, spans the storage compartment and retains an information card and the one or more electronic memory storage device housed therein.

10. The system of claim 9, wherein the protector shield is transparent.

11. The system of claim 10, wherein the transparent protector shield has a front side and a back side, the back side having a first edge opposite a second edge, and wherein the first lip is formed along the first edge of the back side of the transparent protector shield and the second lip is formed along the second edge of the back side of the transparent protector shield and wherein the first lip is configured to receive the first edge of the front side of the base and the second lip is configured to receive the second edge of the front side of the base.

12. The system of claim 9, further comprising a protective insert retained in the depression formed into the base, wherein the protective insert is configured with one or more voids formed into the protective insert corresponding in shape and size to one or more electronic memory storage devices, wherein the voids formed into the protective insert are configured in the size and shape of one or more of a cellular phone SIM card, a secure digital ("SD") card, a mini SD card, a micro SD card, a USB to flash memory adapter, and a compact flash card.

13. The system of claim 12, wherein the protective insert is made of a material that retains an electronic memory storage device therein, wherein the material comprises one or more of a hard material, a soft material, an impressionable material, a foam material, and a foam-like material.

14. The system of claim 9, further comprising one or more magnetic devices attached to the back side of the base, the magnetic devices facilitating attachment of the base to a metallic surface.

15. A method for making a mechanism for protecting and retaining information cards and one or more electronic memory storage devices, the method comprising:

forming a substantially planar, rigid base in a substantially rectangular shape, the rigid base having a front side and a back side, the front side having a first edge opposite a second edge;

forming a protector shield comprising a first lip and a second lip, the first and second lips each configured to receive the first edge and the second edge of the base, wherein the protector shield is selectively attachable to the base;

forming a depression into the base, the depression forming a storage compartment housing one or more electronic memory storage devices, the storage compartment configured so that the protector shield, when attached to the base, spans the storage compartment and retains an information card and the one or more electronic memory storage device housed therein; and forming a protective insert retained in the depression formed into the base, wherein the protective insert is configured with one or more voids formed into the protective insert corresponding in shape and size to the one or more electronic memory storage devices.

16. The method of claim 15, wherein the protector shield is transparent.

17. The method of claim 16, wherein the transparent protector shield has a front side and a back side, the back side having a first edge opposite a second edge and wherein forming the card retainer mechanism further comprises forming the first lip along the first edge of the back side of the transparent protector shield and forming the second lip along the second edge of the back side of the transparent protector shield.

18. The method of claim 15, wherein one of the one or more memory storage devices is one of a cellular phone SIM card, a secure digital ("SD") card, a mini SD card, a micro SD card, a USB to flash memory adapter, and a compact flash card.

* * * * *